US005236192A

United States Patent [19]

Pitzel

[11] Patent Number: 5,236,192

[45] Date of Patent: Aug. 17, 1993

[54] GOLF-SWING TRAINING DEVICE

[76] Inventor: Bernard H. Pitzel, 3436 E. Glenrosa, Phoenix, Ariz. 85018

[21] Appl. No.: 956,966

[22] Filed: Oct. 6, 1992

[51] Int. Cl.[5] ..... A63B 69/36; A63B 21/00

[52] U.S. Cl. ..... 273/186.2; 273/193 S; 482/109; 482/111; 434/252

[58] Field of Search ..... 273/186.2, 186.3, 193 R, 273/193 A, 193 B, 194 R, 194 A, 194 B; 482/109, 111

[56] References Cited

U.S. PATENT DOCUMENTS

| | | | |
|---|---|---|---|
| 1,548,068 | 8/1925 | Sullivan | 273/193 R X |
| 3,360,268 | 12/1967 | Molinari | 434/252 X |
| 3,416,803 | 12/1968 | Batista | 273/193 R X |
| 3,565,444 | 2/1971 | LaRocca | 273/186.2 |
| 3,606,340 | 9/1971 | Tiller | 273/186.2 |
| 3,897,068 | 7/1975 | Staples | 273/186.2 |
| 4,511,147 | 4/1985 | Olsen | 273/193 A |
| 4,576,378 | 3/1986 | Backus | 273/186.2 |
| 4,580,785 | 4/1986 | Toku | 273/186.2 |
| 5,002,275 | 3/1991 | Beutler et al. | 273/35 R |
| 5,100,148 | 3/1992 | Smith | 273/186.2 |

*Primary Examiner*—George J. Marlo

*Attorney, Agent, or Firm*—Antonio R. Durando; Harry M. Weiss

[57] ABSTRACT

A golf-swing training device that comprises a club shaft, one end having a grip and the other end having a generally U-shaped member to which a removable flat paddle is attached. The paddle consists of a generally rectangular structure, approximately 1 foot wide and 4 inches tall, featuring a pair of apertures and a retaining channel on one side for cooperative engagement with the generally U-shaped end of the shaft. The training club is swung like a standard club and used to simulate striking a ball with a square face without the use of a golf ball. Because of its size, the paddle provides a visible indication of the position of the club in the hands of a user, allowing immediate adjustments to be made in the course of the swing. In addition, the drag created by the paddle during the downswing results in a force that requires greater effort on the part of the user than a regular club would demand, which in turn strengthens the muscles used to square the face of the club during the downswing. Weight attachments are also provided to increase the mass of the training club for different levels of exercise.

19 Claims, 1 Drawing Sheet

GOLF-SWING TRAINING DEVICE

BACKGROUND OF THE INVENTION

1. Field of the Invention

This invention is related in general to the field of golf swing practice and training devices and, in particular, to a device of this character that trains a golfer to square more accurately the golf club face during a swing and helps strengthen the muscles a golfer uses in squaring the golf club face and in hitting with an accurately squared face.

2. Description of the Prior Art

Golfers continuously strive for the perfect swing to achieve an accurate and powerful drive that sends the ball a long distance in a straight line toward the target green or hole. To realize this goal golfers typically engage in practice and exercise sessions to improve their technique and to increase the strength of the particular muscles used in various techniques. Golfers may simply practice their swings in the backyard or they may utilize a place designed especially for practicing, such as a driving range. Similarly, they may simply practice with their regular golf clubs or they may use some sort of club or other device specially designed for practice and exercise. A wide variety of such devices has been developed for various purposes.

Some training devices, such as described in U.S. Pat. No. 3,565,444 issued to LaRocca (1968) and in U.S. Pat. No. 4,576,378 issued to Backus (1986), consist of an attachment that is mounted on a standard golf club shaft above the head of the club. LaRocca shows a wing-like member consisting of two portions that, at the start of a drive, are closed to increase air drag and impede the speed of the club head and, as the end of the drive approaches, adjust to an open position to decrease air drag and allow the speed of the club head to increase. Backus describes a thin, flat airfoil with circular openings spaced about the surface. The air drag on the airfoil is affected by varying the orientation of the airfoil to the club head and by plugging or unplugging various holes.

Other kinds of practice devices consist of a shaft to which something other than a conventional club head has been attached. Tiller's U.S. Pat. No. 3,606,340 (1971) describes a device for improving hand and wrist action during golf swings and consisting of a dynamic mass freely pivoted at the end of a golf club shaft in place of the usual rigid club head. U.S. Pat. No. 5,100,148, issued to Smith (1992), shows a body consisting of several easily removable wings positioned on opposite sides of the shaft. The configuration and number of wings can be changed to vary the drag resistance when the shaft is swung like a conventional golf club, thus causing the golfer to assume an improved stance. In U.S. Pat. 3,897,068 issued to Staples (1987), a training device to enable a golfer to improve four different aspects of her swing is described. The device consists of a shaft with a hand grip at one end and, at the other end, an enlarged abutment and a weight member, which will slide off the shaft during improper swing positions and movements.

Training devices with flexible shafts have also been suggested. A golf-swing practice device, comprising a flexible shaft with a weight attached to one end, is described in U.S. Pat. No. 5,100,148, issued to Miyamoto (1978). The flexibility of the shaft and the gravity exerted by the weight help train the user to delay the uncocking of the wrists. Toku, in U.S. Pat. No. 4,580,785 (1986), describes another flexible shaft. This one is hollow with a flexible, thin metal strip positioned within it and a conventional golf club head attached to it. A rubbing sound and a vibration results when the club is not swung properly, enabling the golfer to identify an improper swing and take steps to correct it.

U.S. Pat. No. 5,002,275, issued to Beutler (1991), describes a swing training device consisting of a blade that floats on a shaft creating air resistance when swung and biased so that the blade remains at a constant angle relative to the path of the swing, thus allowing the user to improve his swing and strengthen the appropriate muscle groups.

Any golf training device will have as its ultimate objective the perfect swing, achieved by a combination of position training, technique practice and appropriate muscle development. What varies among available devices is obviously the structure of the physical member or apparatus employed to accomplish the objective. One broad category of devices includes those that train the golfer by indicating when he is performing incorrectly, such as the shaft with a member that falls off or that makes a vibrating sound during an improper swing. In contrast, another broad category is comprised of devices that train the golfer by attempting to force her to perform in a particular manner, such as the devices where wings have been added to the golf club or where the club head has been replaced with a dynamic mass that freely pivots.

A golfer decides which training approach to use (one that indicates incorrect position or one that forces correct position) and then chooses among the available devices within the category. What the golfer chooses is largely a matter of pure personal preference, of selecting something individually acceptable. Because of the differences in body shapes, strength and abilities, different golfers will perceive different devices as better serving their needs. Furthermore and very importantly, most golfers use a variety of techniques, exercises and devices for training and practice.

The present invention recognizes that among training devices "one size does not fit all," it addresses the need each individual golfer has for variety in his training program and it responds to the golfer's unending quest for another path to the perfect swing by providing a different device that is simple and economical to construct, easy to use and effective. This invention focuses on training a golfer to properly square a golf club during a swing and on strengthening and developing the muscles used in the squaring action. In so doing, the golfer is offered a device which both attempts to force a correct position and also provides a visual indication of improper performance.

BRIEF SUMMARY OF THE INVENTION

One objective of this invention is a device to train a golfer to properly square a golf club and maintain a squared golf club face through the hitting area of the swing.

Another objective of this invention is a device to strengthen the hand, wrist, arm and body muscles used in squaring the golf club face and maintaining the squared face in the impact or hitting area of the swing.

A further goal of the invention is a specially shaped and sized paddle placed on a golf club shaft that gives a player immediate feedback about the quality of his swing.

Another objective of the invention is a golf-swing training device the size of which may be varied or to which weight-pieces may be added for increasing the muscle strengthening capabilities of the device.

An additional goal is a device that trains a golfer to achieve a correct swing position and also provides the golfer with a visual indication of improper performance.

Yet another goal of the invention is a device that is simple and economical to construct, is easy to use, does not require complicated mounting or assembly and can be easily disassembled for compact storage and transportation.

A final objective of this invention is a golf-swing training device that does not require the use of either a real or a practice golf ball, thereby enabling use in areas where it would not be feasible if a ball were required.

Therefore, according to these and other objectives, the present invention comprises a golf club shaft, one end having a grip and the other end having a generally U-shaped member to which a removable flat paddle is attached. The paddle consists of a generally rectangular structure, approximately 1 foot wide and 4 inches tall, featuring a pair of apertures and a retaining channel on one side for cooperative engagement with the U-shaped end of the shaft. The training club is swung like a standard club and is used to simulate hitting a golf ball. Because of its size, the paddle provides a visible indication of the position of the club in the hands of a user, allowing immediate adjustments to be made in the course of the swing. In addition, the drag created by the paddle during the downswing results in a force that requires greater effort on the part of the user than a regular club would demand, which in turn strengthens the muscles used to force the club into a square position through the impact area. Weight attachments are also provided to increase the mass of the training club for different levels of exercise.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

Figure 3:
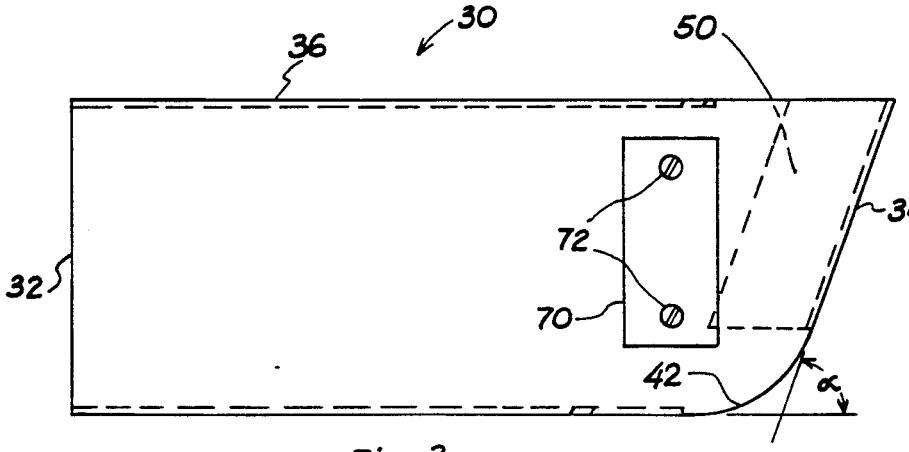
FIG. 3 shows the paddle of the invention in elevational view.
Figure 6:
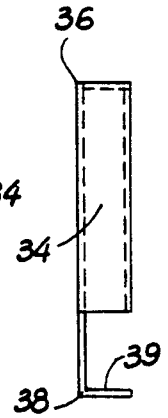
FIG. 6 is a right side view of the paddle.

This invention lies in a device that trains a golfer to square more accurately the golf club face during a swing and helps increase the strength of the muscles a golfer uses in squaring the golf club face and in hitting with an accurately squared face. Referring to the drawings, wherein like parts are designated throughout with like numerals and symbols, FIG. 1 illustrates the preferred embodiment of the invention.

Figure 1:
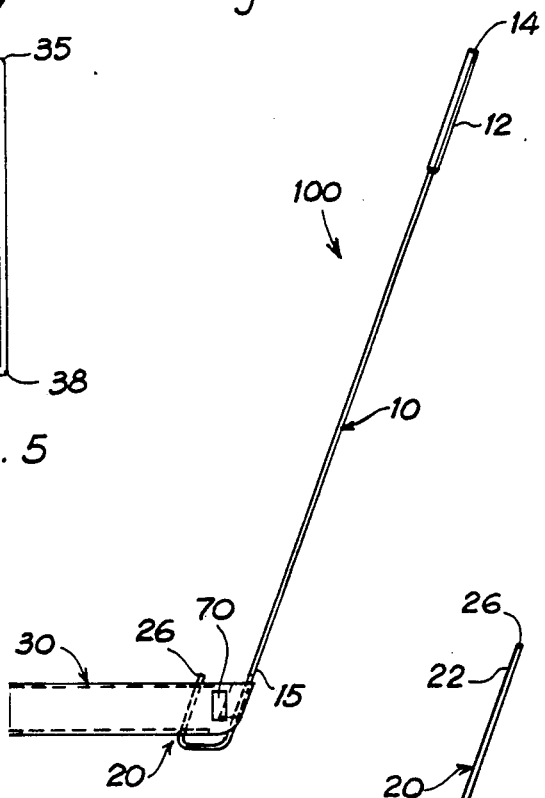
FIG. 1 illustrates the invention comprising a golf club shaft having a grip on one end and a U-shaped member at the other end to which a removable paddle is attached.
Figure 2:
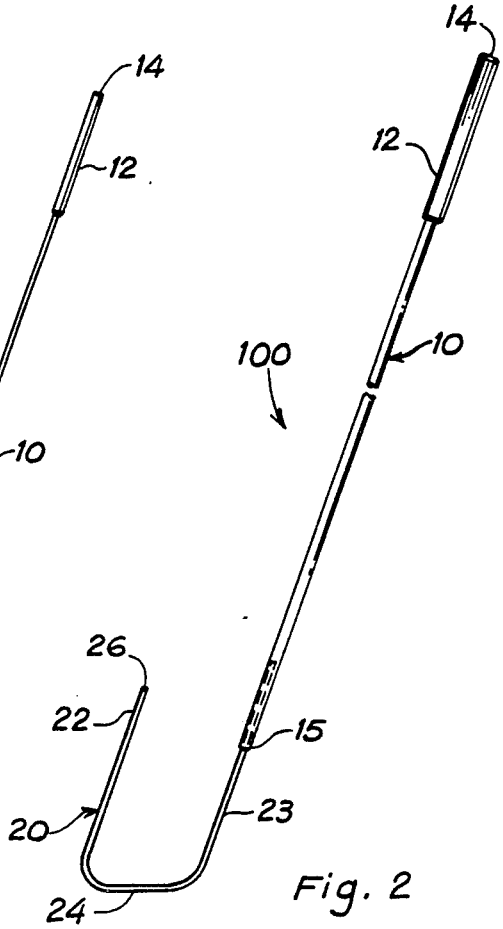
FIG. 2 shows the golf club shaft portion of the invention.

As seen in FIG. 1 and FIG. 2, the swing training device 100 comprises a conventional golf club shaft 10 having a conventional hand grip 12 covering the upper end 14 of the shaft and a paddle-connecting member 20 attached to or formed as an integral part of the lower end 15 of the shaft. Any commercially available type of golf club shaft and hand grip made from any suitable material, as would be known to one skilled in the art, are acceptable for constructing the shaft 10 of the invention. The length of the shaft used is not critical to the functioning of the invention but should be the same as the length of the particular club with which a golfer wishes to practice. The length of a driver is preferable because most golfers typically have problems in hitting squarely with that club.

The paddle-connecting member 20 is shown in the preferred embodiment as a rigid, modified U-shaped tubular rod with a diameter substantially equal to that of the lower end 15 of the shaft or, for purposes of attachment thereto, with an outside diameter slightly smaller than the inside diameter of the shaft. The member 20 consists of a right arm 23, coaxial with the shaft 10, and a left arm 22 approximately 5 inches long and positioned parallel to each other about 4 inches apart. The two arms are joined by a coupling section 24, which in the preferred embodiment (modified U-shape) is a straight segment curved at each end so that the two arms 22 and 23 are parallel to each other. The specific configuration of the coupling section 24 is not critical to the invention. What is critical is that the paddle-connecting member 20 consists of two parallel arms capable of rigid connection with the paddle portion of the invention, as detailed below. Thus, the coupling section 24 joining the two arms 22 and 23 of the paddle-connecting member 20 could be configured in any manner so long as it does not interfere with the attachment of the paddle to the shaft portion of the invention, nor with the swing of the paddle past the ground according to normal golf-swing action.

As mentioned above, the shaft and paddle-connecting member may be molded as one single piece, or otherwise they may be attached in a permanent fashion, such as by welding, gluing, riveting, or the like. In the alternative, the paddle-connecting member could be a separate, removable piece fastened to the shaft, such as by a threaded connection (not shown in the drawings). In such a case, the right arm of the connecting member would be lengthened with the additional length threaded for insertion into the lower end 15 of the shaft 10, wherein a conforming threaded housing would be provided, thereby allowing the tip of the right arm to be screwed securely into place. The addition of several threaded inches to the length of the right arm would enable a user to adjust the length of the shaft by screwing only so much of the extension into the shaft as the user desires. A lock-nut or other equivalent device would be provided to secure the position of the paddle-connecting member 20 in the lower end 15 of the shaft. Because the swing training device 100 is used in a swinging action, the method of attachment must always be secure enough to remain intact as the device is swung. Obviously, any method of attaching the paddle-connecting member 20 to the shaft 10 that accomplishes the functional relationship described above is acceptable to practice the invention.

In the preferred embodiment, the paddle-connecting member 20 may be made of aluminum, steel, or fiberglass, the same materials used in the construction of conventional golf clubs. However, any material is acceptable so long as the paddle-connecting member 20 is strong enough to withstand the swinging motion of the training club in use and so long as the material used is compatible for attachment to the shaft 10.

Removably attached to the paddle-connecting member 20 is a paddle 30 formed as a flat-faced, generally rectangular sheet of rigid material, such as metal or plastic, as seen in FIG. 1 and FIG. 3. The left edge 32 of the paddle is substantially perpendicular to the top edge 36 and bottom edge 38, which are parallel to each other. The right edge 34 instead is formed at an angle $\alpha$ of approximately 70 degrees with respect to the bottom edge 38, as shown in FIG. 3, and forms a rounded corner 42 with the lower edge 38. The angular orientation of the right edge 34 of the paddle 30 generally corresponds to the angular relationship that the shaft of a golf club has to the ground when it is held in addressing a golf ball, which is found to be typically 70 degrees.

Figure 4:
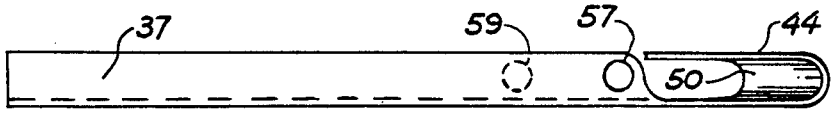
FIG. 4 is a top view of the paddle.
Figure 5:
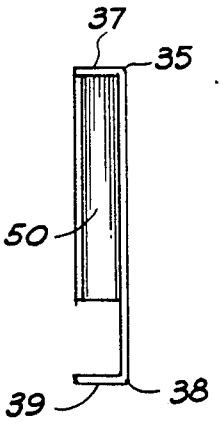
FIG. 5 is a left side view of the paddle.

As seen in FIG. 4 and FIG. 5, the top edge 36 and the bottom edge 38 of the sheet of material constituting the paddle 30 are folded backward 90 degrees to form a top lip 37 and a bottom lip 39, each about ¾-inch wide. As particularly illustrated in FIG. 4, the right edge 34 of the paddle 30 is curved backward 180 degrees, fashioning a rounded fold 44 to form an open channel 50 at an angle $\alpha$ with respect to the bottom edge 38. The channel 50 is sized to accept and accommodate tightly the right arm 23 of the paddle-connecting member 20. Portions of the top lip 37 and bottom lip 39 in the proximity of the formed channel 50 are removed as necessary to leave unobstructed the access to the channel, so that the lower end 15 of the shaft 10 and the right arm 23 of the paddle-connecting member 20 may be inserted into the channel.

In the preferred embodiment, the paddle 30 is about 4½ inches tall and the upper edge 36 is 12 to 15 inches long. Because the right edge 34 of the paddle is slanted, the lower edge 38 will be approximately 1½ inches or more shorter, depending on the angle $\alpha$ and the exact dimensions of the paddle. The slanted right edge 34 is straight except for the rounded corner 42 approximately 1 to 1.5 inches long that may be provided at the bottom.

As illustrated in FIG. 4, a round upper hole 57 is placed on the upper lip 37 of the paddle 30 and a rounded lower hole 59 is placed on the lower lip 39 of the paddle. These holes are positioned in relationship to each other and to the channel 50 so as to create an imaginary corridor running parallel to the channel 50 at a distance equal to the spacing between the two arms 22 and 23 of the paddle-connecting member 20. The holes 57 22 and 59 have a diameter slightly larger than the diameter of the left arm 22 of the connecting member 20. Thus, when the right arm 23 of the connecting member is inserted into the channel 50, the left arm 22 of the connecting member will fit tightly into the upper and lower holes 57 and 59 to firmly retain the paddle in place. Obviously, the two holes 57 and 59 are described as round by way of illustration, but any shape would be acceptable so long as it conformed to the cross-sectional shape of the left arm 22 which is to be inserted therebetween.

As illustrated only in FIG. 1, in the upper right-hand corner of the paddle 30 a weight-piece 70 may be attached to increase the mass of the paddle. In the preferred embodiment, the weight-piece is shown as a rectangularly-shaped segment of steel about 3/16 of an inch thick, three inches long and 1½ inches wide, that is attached to the paddle 30 by two screws 72. However, any functionally equivalent shape and method of attachment of the weight-piece 70 is acceptable.

The paddle 30, in its preferred embodiment, is made of plastic; the combined weight of the paddle 30 and one added weight-piece, as seen in FIG. 1, is approximately one pound, corresponding to the normal weight of a driver. As muscles become strengthened by use of the swing training device, additional weight-pieces may be attached to the paddle 30 as the use desires. It is contemplated that it is most beneficial t increase the weight of the panel in three- to four-ounce increments and, therefore, in the preferred embodiment of the invention each additional weight-piece is designed to weigh three or four ounces. However, additional weight-pieces of any reasonable measure would obviously fall within the scope of the invention.

To assemble the various parts of the swing training device 100, the paddle-connecting member 20 is first attached to the golf club shaft 10. One or more weight-pieces 70 are attached to the paddle 30, if the user so desires. The paddle is then placed on the golf club shaft by snapping the shaft into the channel 50 on the right side of the paddle 30 and sliding the paddle downward on the shaft after positioning it so that the tip 26 of the left arm 22 of the paddle-connecting member 20 may slide first through the lower hole 59 and then through the upper hole 57 as the paddle 30 is moved downward. The downward motion stops and further movement is prevented when the bottom hole 59 and the bottom mouth of the channel 50 come to rest against the coupling section 24 of the paddle-connecting member 20

To use the assembled swing training device, the golfer assumes his normal address position, squares the paddle 30 as he would a conventional golf club face and then starts the back swing allowing the paddle to rotate to a normally open position at the top of the back swing as would be done if a conventional golf club and ball were being used. During the downswing, air pushes against the paddle, attempting to force it to maintain the open position in clockwise direction relative to the shaft. The user must counteract and compensate for this action by applying a counterclockwise force to the shaft during the downswing, thereby causing the paddle to close to the correct squared position through the impact area at the bottom of the swing. If the user over-compensates by applying too much counterclockwise force at any point during the downswing, the paddle will respond accordingly. The size and shape of the paddle enable the user to both see and feel improper swing movements as well as the consequence of any actions taken to correct an improper swing.

Since the club speed varies at different points during the downswing, the amount of counterforce needed at various points of the swing path will vary also, increasing as the speed of the swing increases. The physical characteristics and skill level of a particular golfer will also affect the amount of counterforce required at any given point. A strong-wristed golfer who swings relatively fast will apply counterforce differently than a weak-wristed golfer who swings relatively slowly. The golfer who tends to slice will need to apply counterforce differently than the golfer who tends to hook. The swing training device automatically compels the user to adjust his movements in a manner compatible with the relevant factors. The device teaches the golfer and induces him to use the proper hand, wrist, arm and body position required to square a club face and maintain the squared position during the impact area of the swing; further, the device strengthens the specific muscles used in achieving and maintaining the proper positions as use of the muscles increases. In addition, increasing the weight of the paddle by adding weight-pieces and/or increasing the size of the paddle will enable the user to further increase muscle mass and strength, in the same way that a baseball player tones his muscles before coming to the plate by swinging two bats at the same time.

The swing training device 100 may be stored with regular clubs assembled and ready for use or it may be easily disassembled for more compact storing and transporting. Since the device is not used with either a regular or a practice golf ball, it may be used in less spacious areas that could not accommodate a traveling ball.

Although the invention is shown in an embodiment for a right-handed golfer, a mirror image of the paddle would be suitable for a left-handed golfer to use, as one skilled in the art would know.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

What I claim as my invention is:

1. A golf-swing training device, comprising:

a conventional golf club shaft having an upper end and a lower end;

a conventional hand grip covering said upper end of the shaft;

a paddle-connecting member attached to said lower end of the shaft and comprising a first arm coaxial with said shaft, a second arm parallel to said first arm, and a coupling section therebetween; and a substantially rectangular paddle consisting of a flat-faced sheet of rigid material having two side edges and top and bottom edges, wherein one side edge is curved to form an open channel capable of accommodating said first arm of the shaft, and wherein said top and bottom edges are folded to form a top lip and a bottom lip, each containing a hole slightly larger than the cross-sectional size of said second arm and positioned at a distance from said open channel equal to the spacing between said first and second arms of the paddle-connecting member, so that when the first arm is inserted into the channel the second arm fits tightly into said holes to firmly retain the paddle in place.

2. The apparatus described in claim 1, wherein said paddle-connecting member consists of a single-piece rigid tubular rod with a diameter substantially equal to that of said lower end of the shaft and wherein said first and second arms are approximately 5 inches long and are positioned parallel to each other about 4 inches apart.

3. The apparatus described in claim 1, wherein said coupling section consists of a straight segment curved at each end between said two arms so that the two arms are parallel to each other.

4. The apparatus described in claim 1, wherein said shaft and paddle-connecting member are molded as one single piece.

5. The apparatus described in claim 1, wherein said paddle-connecting member consists of a separate, removable piece having an outside diameter smaller than the inside diameter of said lower end of the shaft for fastening thereto and slidable adjustment therewith.

6. The apparatus described in claim 5, wherein said paddle-connecting member is fastened to said shaft by a threaded connection accomplished by lengthening and threading said first arm of the paddle-connecting member and by providing a conforming threaded housing in said lower end of the shaft, thereby allowing said threaded arm to be screwed securely into place.

7. The apparatus described in claim 6, further comprising a lock-nut to secure the position of said threaded arm in the lower end of said shaft, thereby enabling the length of the shaft to be adjusted by screwing only so much of the threaded extension into the shaft as desired.

8. The apparatus described in claim 1, wherein said one curved side edge is slanted at an angle of approximately 70 degrees with respect to said bottom edge, so that the angular orientation of the said edge generally corresponds to the angular relationship that the shaft of a golf club has to the ground when it is held in addressing a golf ball by a user.

9. The apparatus described in claim 8, wherein said slanted edge forms a rounded corner with said bottom edge.

10. The apparatus described in claim 9, wherein said paddle is about 4½ inches tall and said top edge is 12 to 15 inches long.

11. The apparatus described in claim 10, wherein said rounded corner between the slanted edge and the bottom edge is approximately 1 to 1.5 inches long.

12. The apparatus described in claim 1, wherein said top lip and bottom lip are about ¾ of an inch wide.

13. The apparatus described in claim 1, wherein portions of said top lip and bottom lip in the proximity of said formed channel are removed as necessary to leave the access to the channel unobstructed, thereby allowing said lower end of the shaft and said first arm of the paddle-connecting member to fit tightly into the channel.

14. The apparatus described in claim 1, further comprising a weight-piece attached to said paddle.

15. The apparatus described in claim 14, wherein said weight-piece is a rectangularly-shaped segment of steel about 3/16 of an inch thick, three inches long and 1½ inches wide.

16. The apparatus described in claim 15, wherein said weight-piece is attached by means of screws.

17. The apparatus described in claim 14, wherein said weight-piece weighs three to four ounces.

18. The apparatus described in claim 1, wherein said paddle is made of plastic.

19. The apparatus described in claim 1, wherein the combined weight of said paddle and said weight-piece is approximately one pound.

* * * * *